US006561678B2

(12) United States Patent
Loughrey

(10) Patent No.: US 6,561,678 B2
(45) Date of Patent: May 13, 2003

(54) VARIABLE FOCUS INDIRECT LIGHTING FIXTURE

(76) Inventor: James F. Loughrey, 4576 Echo La., Stacy, MN (US) 55079

( * ) Notice: Subject to any disclaimer, the term of this patent is extended or adjusted under 35 U.S.C. 154(b) by 45 days.

(21) Appl. No.: 09/775,683

(22) Filed: Feb. 5, 2001

(65) Prior Publication Data

US 2002/0105807 A1 Aug. 8, 2002

(51) Int. Cl.[7] ..... F21V 7/16

(52) U.S. Cl. ..... 362/282; 362/295; 362/322; 362/346

(58) Field of Search ..... 362/148, 217, 362/225, 297, 284, 324, 346, 282, 319, 322, 298

(56) References Cited

U.S. PATENT DOCUMENTS 3,099,403 A * 7/1963 Strawick ..... 362/224
5,615,943 A * 4/1997 Coldren ..... 362/225
5,887,969 A * 3/1999 Gordin ..... 362/217
6,053,624 A * 4/2000 Cronk ..... 362/346
6,076,943 A * 6/2000 Lasovsky ..... 362/284
6,244,729 B1 * 6/2001 Waldmann ..... 362/284

* cited by examiner

*Primary Examiner*—Sandra O'Shea
*Assistant Examiner*—Peggy A. Neils
(74) *Attorney, Agent, or Firm*—Lowe Hauptman Gilman & Berner, LLP

(57) ABSTRACT

A variable focus indirect lighting fixture has a pair of first reflectors with each reflector arranged to substantially surround a light source, and a second variable focus reflector positioned in front of the first reflectors. Each of the first reflectors has an opening arranged to provide direct rumination from the light source. The second reflector is positioned in front of each opening of the pair of first reflectors to receive and reflect the lumination from each light source passing through each opening. The second reflector has a pair of inner, concave surfaces arranged such that each inner surface faces a respective opening of the first reflectors and is arranged to receive and reflect the lumination from the respective light source passing through the opening of each of the first reflectors. The inner surfaces are aligned along a center line of the second reflector between the pair of first reflectors. The center line is adjustable to modify the concavity of the inner surfaces of the second reflector. Adjustment of the center line varies the focus of the light output reflected from the second reflector of the fixture.

13 Claims, 8 Drawing Sheets

VARIABLE FOCUS INDIRECT LIGHTING FIXTURE

FIELD OF THE INVENTION

The present invention relates generally to lighting fixtures and, more particularly, to lighting fixtures providing indirect light or luminance. Still more particularly, the present invention relates to variable focus indirect lighting fixtures.

BACKGROUND ART

Indirect lighting is widely recognized as the best type of lighting as it provides even illumination without the glare of direct illumination from the light source. Indirect lighting which resembles lumination from a skylight is the most desirable type of lighting. The benefit of indirect lighting is that the source of light, i.e., the point of lumination, is never visible. It is similar to the illumination received on a cloudy day where the sun is not visible. The lack of glare is one of the prime benefits of indirect lighting. The even distribution of the lighting is also a major benefit.

Indirect lighting through skylights can be focused on a specific area by the size of the skylight and the distance between the roof and the ceiling where the skylight is located. The ability to control indirect lighting to cover the space to be illuminated or the task area to be illuminated is not available through the use of commercially available lighting fixtures. Thus, there is a need in the art for an indirect lighting fixture control.

A prior approach to solving the problem of providing indirect lighting for indoor recessed lighting environments is a recessed, indirect lighting fixture, e.g., the Atrium fixture available from Eclairage Axis Lighting Inc. FIG. 1 is a perspective view of the recessed, indirect lighting fixture of the prior art.

A recessed, indirect lighting fixture 10 is mounted in a typical office environment ceiling 12. The ceiling 12 includes support beams 14 supporting ceiling panels 16 in a typical grid arrangement. These support beams 14 are normally suspended from an office space ceiling (not shown) via support wires (not shown). The lighting fixture 10 rests on, or is attached to, support beams 14 and fully covers an opening 15 in ceiling 12 of the same size as ceiling panel 16. Typical ceiling panel 16 dimensions are either two foot square or two feet by four feet.

The lighting fixture 10 includes a light source 18 mounted above ceiling 12 on opposite interior sides of the fixture 10 and substantially vertically aligned over the support beam 14. The light source 18, e.g., a fluorescent light tube, is partially surrounded by a channel 20, e.g., an aluminum extruded channel, extending coextensive with the opening 15 in the ceiling 12 for the fixture 10. The channel 20 is generally U-shaped and directs light from light source 18 toward a concave surface 21 formed by a curved reflector 22 forming a portion of the top surface of fixture 10.

Two curved reflectors 22 are joined together at common edges along a centerline of fixture 10 to form an upper side of the fixture. A single piece of material having two curved portions may be used in place of two separate pieces being joined. The transversely extending ends of the fixture 10 not having light source 18 have a substantially vertical end wall 24 connected to each of the curved reflectors 24 along a top edge and rest on, or are attached to, a transverse beam support 14*a* along a lower edge thereof.

Using the above-described lighting fixture 10, light is transmitted from light source 18 toward the concave surface 21 of curved reflector 22. The light reflects off concave surface 21 and passes through opening 15 to illuminate the office space below ceiling 12. As depicted in the side view of fixture 10 in FIG. 2, the angle of light distribution 26 using the recessed, indirect lighting fixture described above is approximately one hundred fifty (150) degrees. Thus, the fixture 10 provides a uniform light distribution over a large angle. However, there are many situations where a uniform distribution of light is needed only in a specific location, e.g., conference rooms, television studios, football or basketball arenas. In these situations, it is desirable to have more light on a specific subject or location, e.g., players on the basketball court or documents being read at a conference table, and fixture 10 is not able to focus the light as required. Therefore, there is a need in the art for a focussed indirect lighting fixture.

Further, certain applications of indirect lighting require different focus settings at different times. For instance, if a person is making a presentation in a conference room the lighting should be focussed on the presenter and the presentation, i.e., a narrow focus; however, if a discussion is occurring at the conference table, the lighting should be focussed on the table and any documents at the table, i.e., a broader focus. A typical solution for multiple levels of lighting focus is to use multiple differing light fixtures, e.g., recessed fluorescent lighting for a broader focus and incandescent directional lighting for narrow focus. Thus, there is a need in the art for a variable focus indirect lighting fixture.

The current practice in lighting is to use uplighting on suspended fixtures using the ceiling as the reflector. This practice is extremely inefficient and impractical and creates hot spots on the ceiling without controlling where the light is to be directed.

Current practice and currently available products on the market are all fixture designs with the lamps and reflectors being set with no adjustability or variation available either from the factory or in the field at the fixture. A field adjustable lighting fixture is particularly suited to television studios or video conferencing rooms. In television studios, the trend is toward the use of fluorescent lighting because such lighting provides a more uniform lumination lacking hot spots at a more comfortable cooler temperature, i.e., the person or persons under the light are not subjected to heat from the lights. The use of variable focus direct lighting fixtures has long been used in theater and television studios to control the beam spread of the luminaires.

Television studios have long used skrims or diffusers over either incandescent or fluorescent fixtures to soften the effect of the light source. Unfortunately, this has resulted in fires from the very hot incandescent lamps and a loss of light intensity when used with fluorescent lamps. A variable focus indirect lighting fixture would allow open aperture fixtures to efficiently disperse light over a controllable area with no glare and no direct light. Therefore, there is a need in the art for a variable focus indirect lighting fixture for use in television studios, video conference rooms, and theaters.

SUMMARY OF THE INVENTION

It is an object of the present invention to provide a variable focus indirect lighting fixture.

Another object of the present invention is to provide a variable focus indirect lighting fixture for use in television studios, video conference rooms, and theaters.

The above-described objects are achieved by a variable focus indirect lighting fixture. The lighting fixture has a pair of first reflectors with each reflector arranged to substantially surround a light source, and a second variable focus reflector positioned in front of the first reflectors. Each of the first reflectors has an opening arranged to direct lumination from the light source. The second reflector is positioned in front of each opening of the pair of first reflectors and arranged to receive and reflect the lumination from each light source passing through each opening of the pair of first reflectors. The second reflector has a pair of inner, concave surfaces arranged such that each inner surface faces a respective opening of the first reflectors and is arranged to receive and reflect the lumination from the respective light source passing through the opening of each of the first reflectors. The inner surfaces are aligned along a center line of the second reflector between the pair of first reflectors. The center line is adjustable to modify the concavity of the inner surfaces of the second reflector. Adjustment of the center line varies the focus of the light output reflected from the second reflector of the fixture.

In a method aspect, variable focussed indirect light is provided from a lighting fixture having at least one light source, a first reflector substantially surrounding the light source, and a second variable focus reflector positioned in front of the first reflector. The first reflector has an opening for directing the lumination from the light source and the second reflector is positioned in front of the opening of the first reflector to receive and reflect the lumination from the light source passing through the opening of the first reflector. The second reflector has an adjustable center point for raising and lowering the center point of the second reflector thereby adjusting the focus of lumination transmitted by the fixture. The center point of the second reflector is raised or lowered to adjust the focus of light transmitted from the fixture to an area to be illuminated.

Further, a lighting fixture apparatus is described as having a first reflector for substantially surrounding a light source, and a second variable focus reflector positioned in front of the first reflector. The first reflector has an opening arranged to direct lumination from the light source and the second reflector is arranged to receive and reflect the lumination from the light source passing through the opening of the first reflector. The second reflector has an inner, reflective, curved surface facing the opening of the first reflector and the second reflector has an adjustable center point arranged to modify the curvature of the second reflector to adjust the focus of light transmitted from the fixture to an area to be illuminated.

In an additional embodiment, the apparatus described above includes a pair of first reflectors surrounding a pair of light sources and the second reflector includes a pair of inner, reflective, curved surfaces for receiving and reflecting the lumination from the light source.

In a still further embodiment, the apparatus described above includes multiple first reflectors surrounding multiple light sources and the second reflector includes multiple inner, reflective, curved surfaces corresponding to the multiple first reflectors for receiving and reflecting the lumination from the light sources.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

BEST MODE FOR CARRYING OUT THE INVENTION

Figure 3:
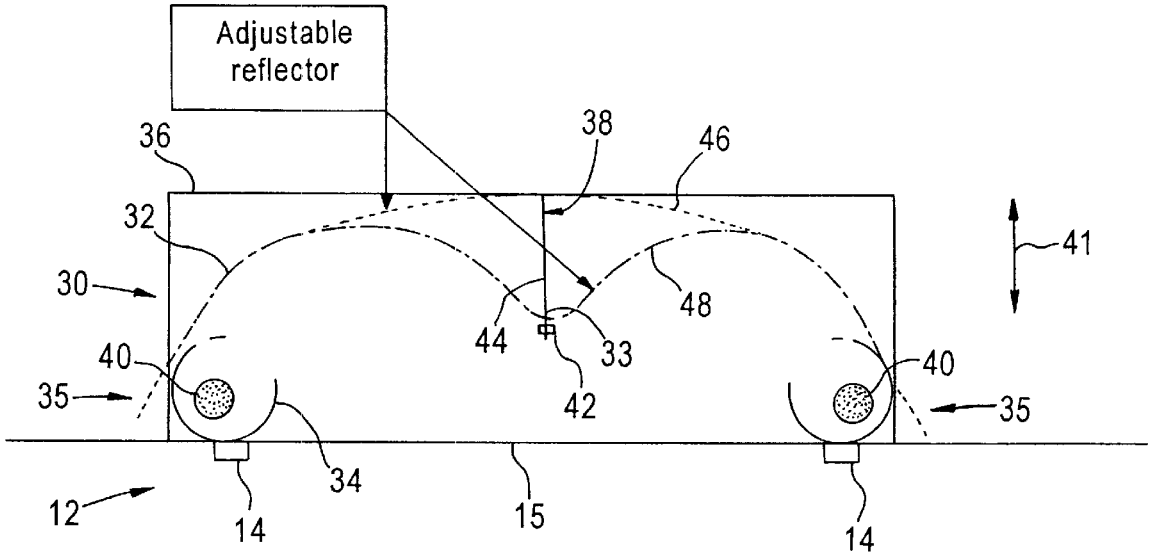
FIG. 3 is a side view of an embodiment of the present invention.

The Variable Focus Indirect Lighting Fixture (VFILF), generally indicated by reference numeral 30 in FIG. 3, of the present invention controls the focus of indirect lighting from a lighting fixture 30 by using reflectors 32 having a variable shape. The beam angle of a lighting fixture is defined as the angle where 50% of the light output of the fixture is concentrated. The field angle of a lighting fixture is defined as the angle where 90% of the light output of the fixture is concentrated. The center of the reflector 32 is adjustable either at the fixture or at the time of manufacture so that the beam angle and the field angle is controllable to direct the luminance output of the fixture 30.

The overhead profile of the lighting fixture 30 may be of any shape necessary for a given application, i.e., square, rectangular, circular, or triangular. The VFILF 30 is now described in detail with reference to FIG. 3.

Figure 1:
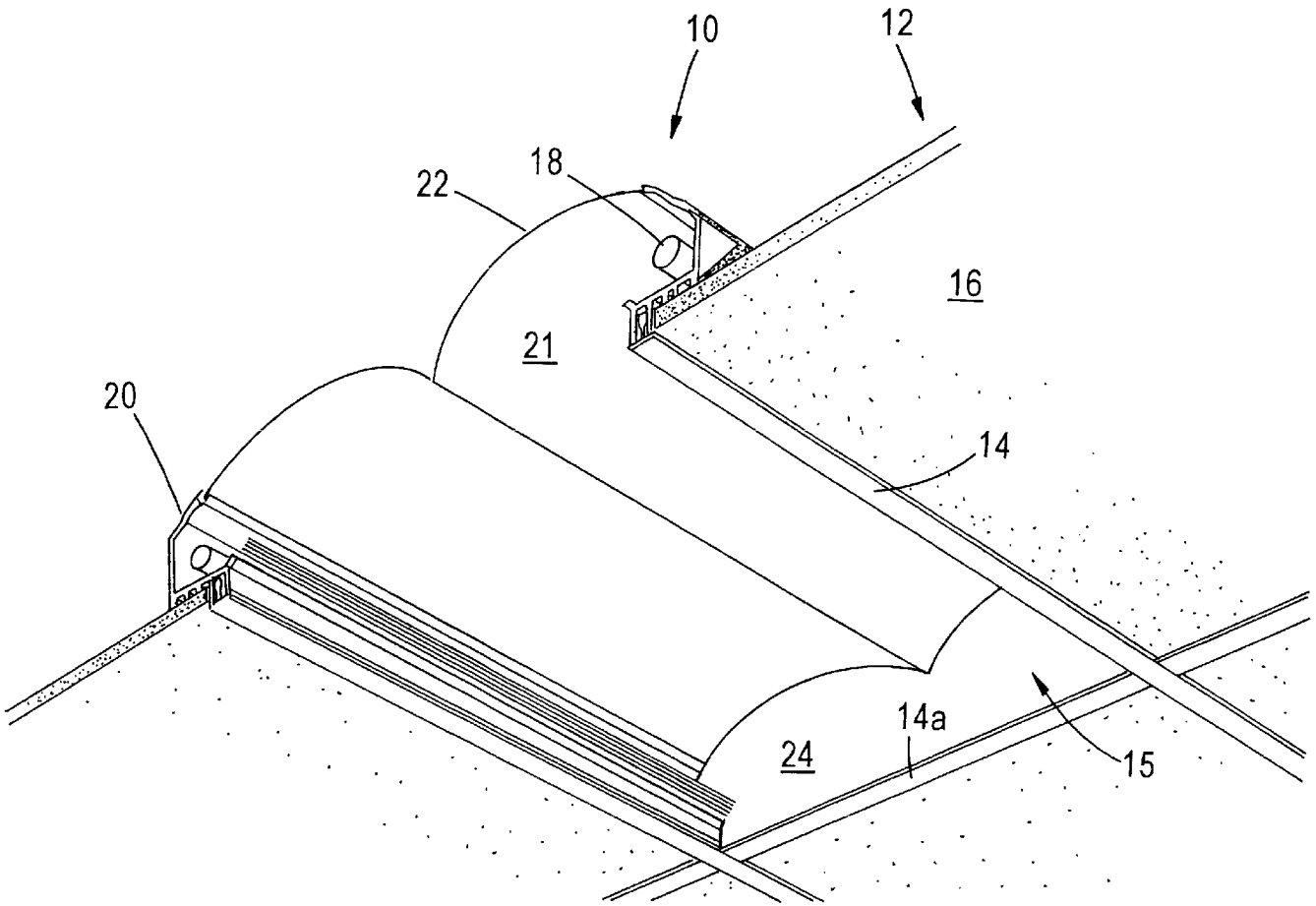
FIG. 1 (PRIOR ART)
FIG. 1 is a perspective view of a prior art indirect lighting fixture.
Figure 2:
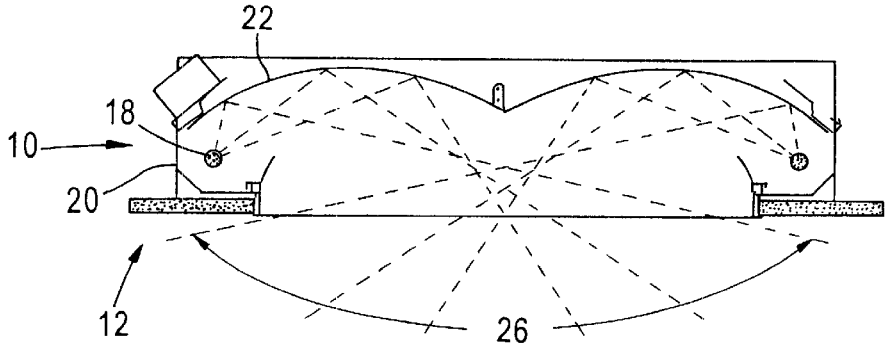
FIG. 2 (PRIOR ART)
FIG. 2 is a side view of the fixture of FIG. 1.

The design of the field adjustable VFILF can be very sophisticated or simple depending upon customer requirements and budget. The VFILF is similar in design to the recessed, indirect lighting fixture 10 of the prior art (FIG. 1 and 2); however, the improved VFILF includes a variable focus adjustability not found on the prior art indirect lighting fixture.

The VFILF 30 is shown positioned within ceiling 12 over ceiling opening 15 and supported by support beams 14. The VFILF 30 includes an upper adjustable reflector 32 positioned above and able to slide over a lower semi-circular reflector 34. A U-shaped frame 36 is positioned over upper reflector 32 for supporting an adjustment device 38 for raising and lowering the center 33 of upper reflector 32. The lower reflector 34 partially surrounds a tight source 40 and directs and reflects the light output of light source 40 toward upper reflector 32. The lower reflector 34 is of a fixed shape and forms a semi-circular reflector, e.g., an elliptical forward throw reflector as known in the art. In alternate embodiments, the lower reflector 34 may be of a type known as segmented, double slotted, or any type or shape able to reflect the light source 40 output toward upper reflector 32.

Figure 6:
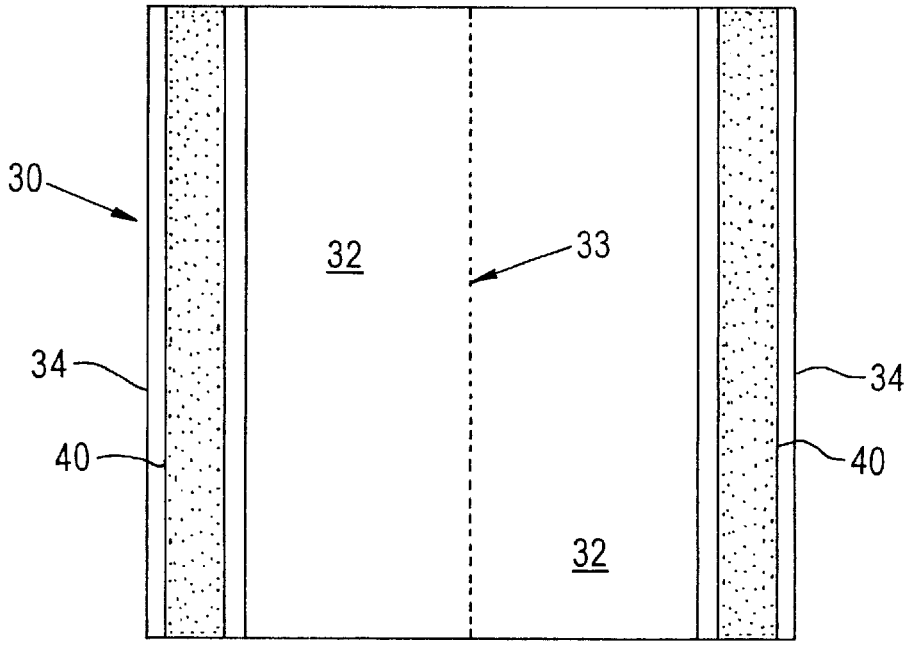
FIG. 6 is a top view of the embodiment of FIG. 3 of the present invention.

The upper reflector 32 is held on top of the lower reflector 34 and slides in and out, i.e., vertically up and down along directional arrow 41 with respect to the side view of FIG. 3 and in and out of the page with respect to the top view of FIG. 6, as required to form the proper arc, e.g., parabolic, of the upper reflector 32 focussing or dispersing the light thrown forward by the lower reflector. That is, the upper reflector 32 reflects light received from light source 40 and lower reflector 34 toward opening 15 in ceiling 12. The distal ends of upper reflector 32 slide past lower reflector 34. With respect to FIG. 3, the distal end 35 of upper reflector 32 protrudes beyond lower reflector 34 when the upper reflector's center point 33 is at its maximum height, i.e., dashed line 46. In this case, the upper reflector 32 slides over and beyond lower reflector 34 as the center point 33 is raised. The upper reflector 32 may be any type of reflective material, e.g., white plastic, aluminum, mylar cloth fabric, or fiberglass, to reflect light from light source 40.

In one alternate embodiment, upper reflector 32 is a stretchable material, e.g., stretchable mylar or another stretchable reflective material, and the distal ends 35 are attached to the upper edge of lower reflector 34. As center point 33 is raised and lowered, the upper reflector 32 stretches to accommodate the change in dimension. Stiffening or support stays (not shown) may be needed in connection with upper reflector 32 in order to produce the curve of upper reflector 32.

Figure 9:
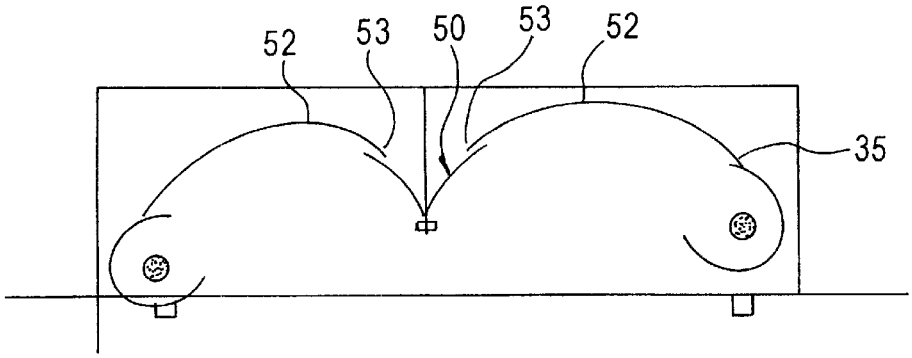
FIG. 9 is a side view of another embodiment of the present invention having a telescoping centerpiece.

In another alternate embodiment depicted in FIG. 9, upper reflector 32 includes a telescoping centerpiece 50 and curved sidepiece reflectors 52 affixed and supported at distal end 35 by the upper edge of lower reflector 34 and supported at the proximal end 53 by telescoping centerpiece 50. As telescoping centerpiece 50 is raised or lowered the curved sidepiece reflectors proximal end 53 slide over the upper portion of the telescoping centerpiece 50 and curved sidepiece reflectors 52 rotate about distal end 35. It is to be understood that more than one telescoping segment may be required in certain embodiments to obtain the necessary curvature and/or length of upper reflector 32.

In most situations, the intended application or installation location dictates the method used to adjust the upper reflector 32, e.g., manual or automatic. The upper reflector 32 is adjusted by raising or lowering the center point 33 of the upper reflector in order to modify the angle at which light is reflected and transmitted from lighting fixture 30. The upper reflector 32 may be deformed in shape over a range of angles from obtuse or nearly flat at the highest position (shown as a dotted line 46) to acute at the lowest position (shown as a dot-dash line 48).

Raising or lowering the center point 33 of the upper reflector 32 can be accomplished by a simple screw similar to those used to open or close a roof vent in a trailer, or by a remote or computer controlled electric motor or an air operated solenoid. As shown in FIG. 3, a wing-nut 42 is threaded on a threaded bolt 44 to raise and lower the center of reflector 32. As wing-nut 42 is threaded onto the bolt 44, the center point 33 is raised toward the U-shaped frame 36 deforming upper reflector 32 toward a more flat position. In effect, the inverted peak formed at the center point 33 of upper reflector 32 is greatest at the lowest position 48 and lowest, or in some cases non-existent at the highest position 46.

Figure 10:
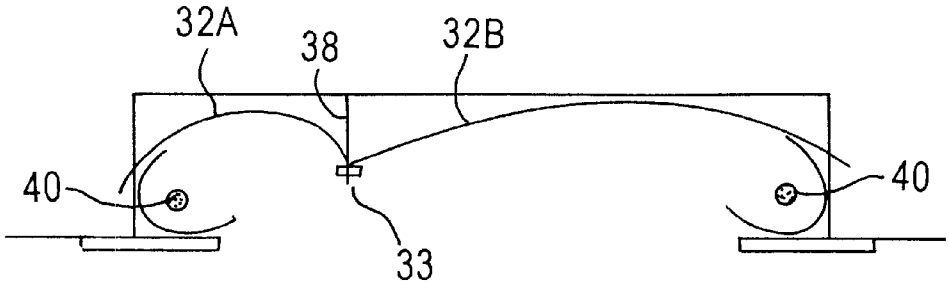
FIG. 10 is a side view of another embodiment of the present invention having an offset adjustment device.

It is to be understood that U-shaped frame 36 is not necessary in all installations and may be replaced by another mechanism to provide support for adjustment device 38, e.g., adjustment device may be attached directly to an overhead support or the ceiling above the drop ceiling 12. Further, it is to be understood that although the present invention is described with respect to a center point 33 located at the center of second reflector 32, the center point need not be located at the center of second reflector 32. In fact, in different installation locations it may be beneficial to have an offset center point 33 in order to provide differing amounts of illumination to different areas. For example as depicted in FIG. 10, the center point 33 and adjustment device 38 may be located more closely to the left-hand light source 40 providing a longer curve to the right-hand inner, reflective surface 32A of second reflector 32 as compared to the left-hand surface 32B.

Figure 11:
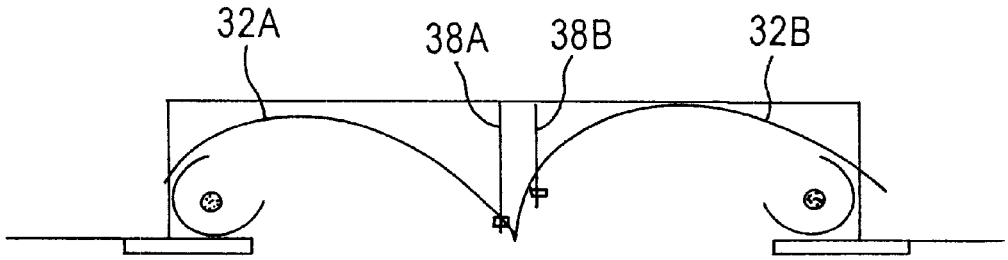
FIG. 11 is a side view of another embodiment of the present invention having individual left and right adjustment devices.

Further still, as depicted in FIG. 11, separate adjustment devices, e.g., left-hand adjustment device 38A and right-hand adjustment device 38B, may be employed to separately adjust the curvature of the left and right-hand portions of the inner, reflective surfaces 32A and 32B of second reflector 32.

Figure 4:
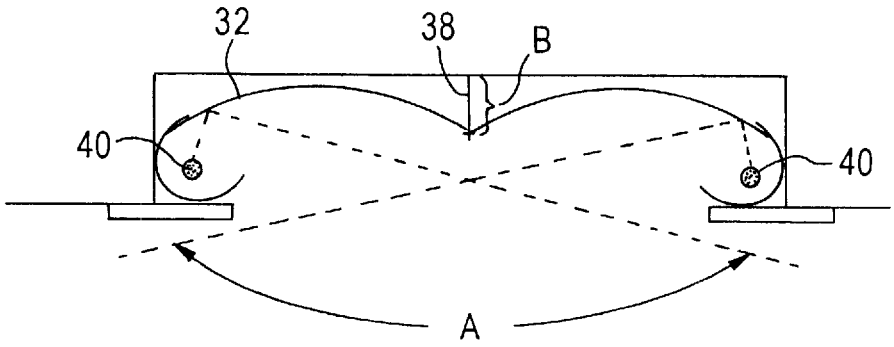
FIG. 4 is a side view of the light distribution angle of the present invention in one configuration.
Figure 5:
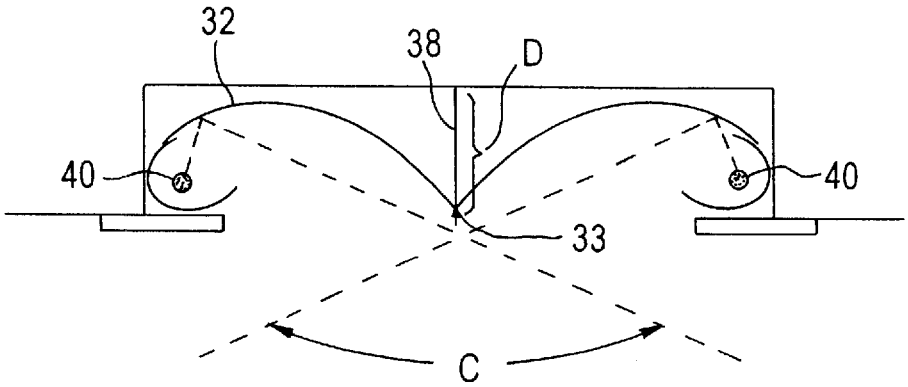
FIG. 5 is a side view of the light distribution angle of the present invention in another configuration.

FIGS. 4 and 5 are side views of fixture 30 of FIG. 3 with variable focus reflector 32 in two different focus positions. In FIG. 4. the focus of reflector 32 is set with the adjustment device 38 set to a length B resulting in a distribution or field angle A of the light from the pair of light sources 40 reflecting off the reflector 32. In FIG. 5, the adjustment device 38 is set to a length D which is longer than length B in FIG. 4, thus deepening penetration of center point 33 into fixture 30. As a result, light from the pair of light sources 40 is reflected at a greater angle from variable focus reflector 32 and forms a distribution or field angle C smaller than angle A in FIG. 4. By adjusting the adjustment device 38 described in detail above, a user can quickly and easily vary the amount of illumination provided to an area from a wide angle distribution, e.g., distribution angle A, or approximately 170 degrees, as in FIG. 4, to a more narrow distribution, e.g., distribution angle C, or approximately 50 degrees, as in FIG. 5.

FIG. 6 is a top view of the VFILF 30 of FIG. 3. As can be seen in FIG. 6, the center point 33 forms a center line of fixture 30 and the light sources 40 are installed along either side of the center line.

Figure 7:
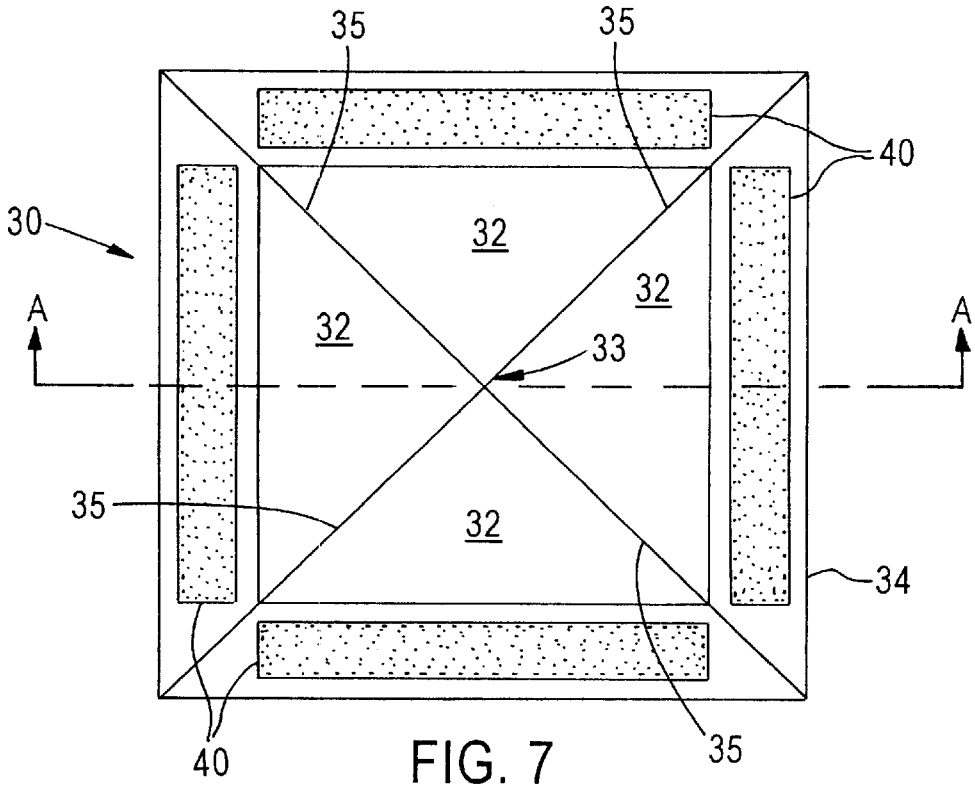
FIG. 7 is a top view of another embodiment of the present invention.
Figure 12:
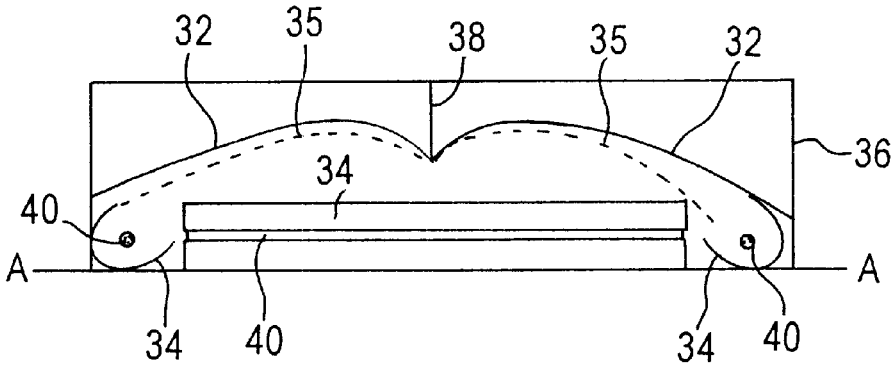
FIG. 12 is a side view of the embodiment of FIG. 7.
Figure 13:
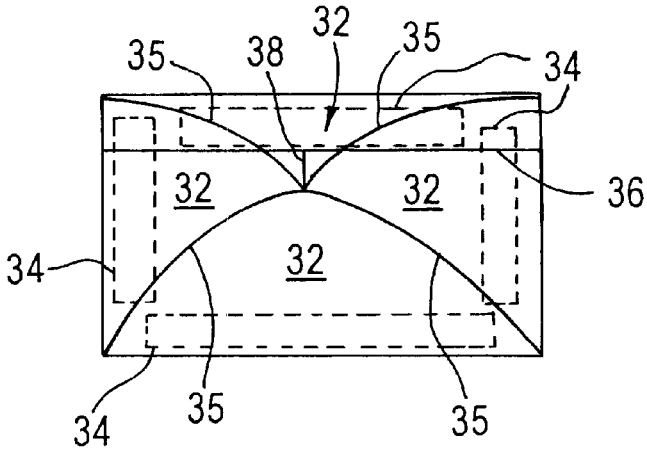
FIG. 13 is a perspective view of the embodiment of FIG. 7.

FIG. 7 is a top view of another embodiment of the VFILF in which four light sources 40 are positioned along corresponding sides of fixture 30 and upper reflector 34 has quadrant forming intersecting center lines 35 intersecting at center point 33. It is to be understood that additional configurations are possible, e.g., triangular or circular. FIG. 12 is a side view of the FIG. 7 embodiment along cut line A. Two intersecting center lines 35 are depicted as dashed lines. FIG. 13 is a perspective view of the FIG. 7 embodiment. The lower reflectors 34 are depicted as dashed lines.

Figure 8:
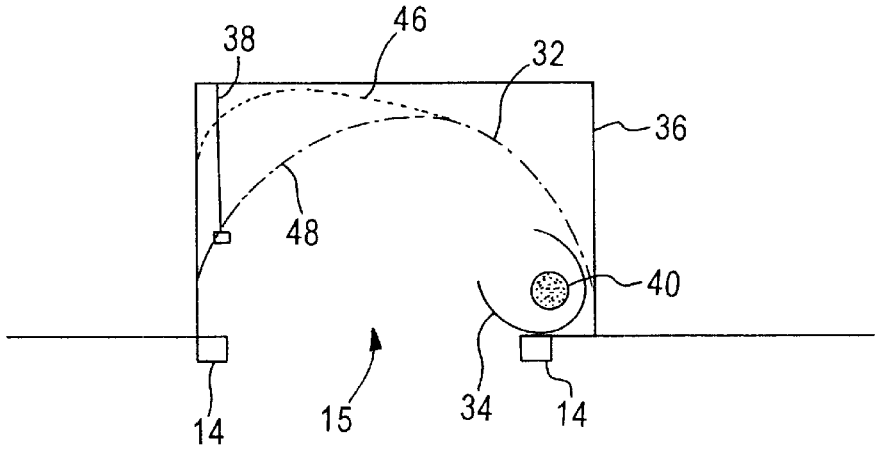
FIG. 8 is a side view of another embodiment of the present invention having a single light source.

FIG. 8 is a side view of another embodiment of the present invention in which only a single light source 40 is used.

Light from light source 40 is reflected off variable focus reflector 32 and transmits through opening 15 to an area to be illuminated. Variable reflector 32 is adjustable by adjustment device 38 over a range of positions including those illustrated by dot-dashed line 48 and dashed line 46.

The physical size of the VFILF 30 can be as small as one foot square or as large as twenty to thirty feet square for large indoor or outdoor installations.

The variable focus fixture 30 can be used indoors or outdoors. The design is the same with respect to light source or lamp placement, aperture, and reflector design. Through the use of multiple lamps and the use of the variable output single constant source light fixture, such as the one described in co-pending application entitled, "Variable output single constant source light fixture" filed on Dec. 1, 2000 having application Ser. No. 09/726,394 and by the same inventor hereby incorporated by reference in its entirety into the present specification, it is possible to have a totally dimmable, focusable indirect lighting fixture. The variable output single constant source light fixture and the VFILF are computer controllable and intended to be used together; either through a single combined interface or through separate individual interfaces.

Figure 14:
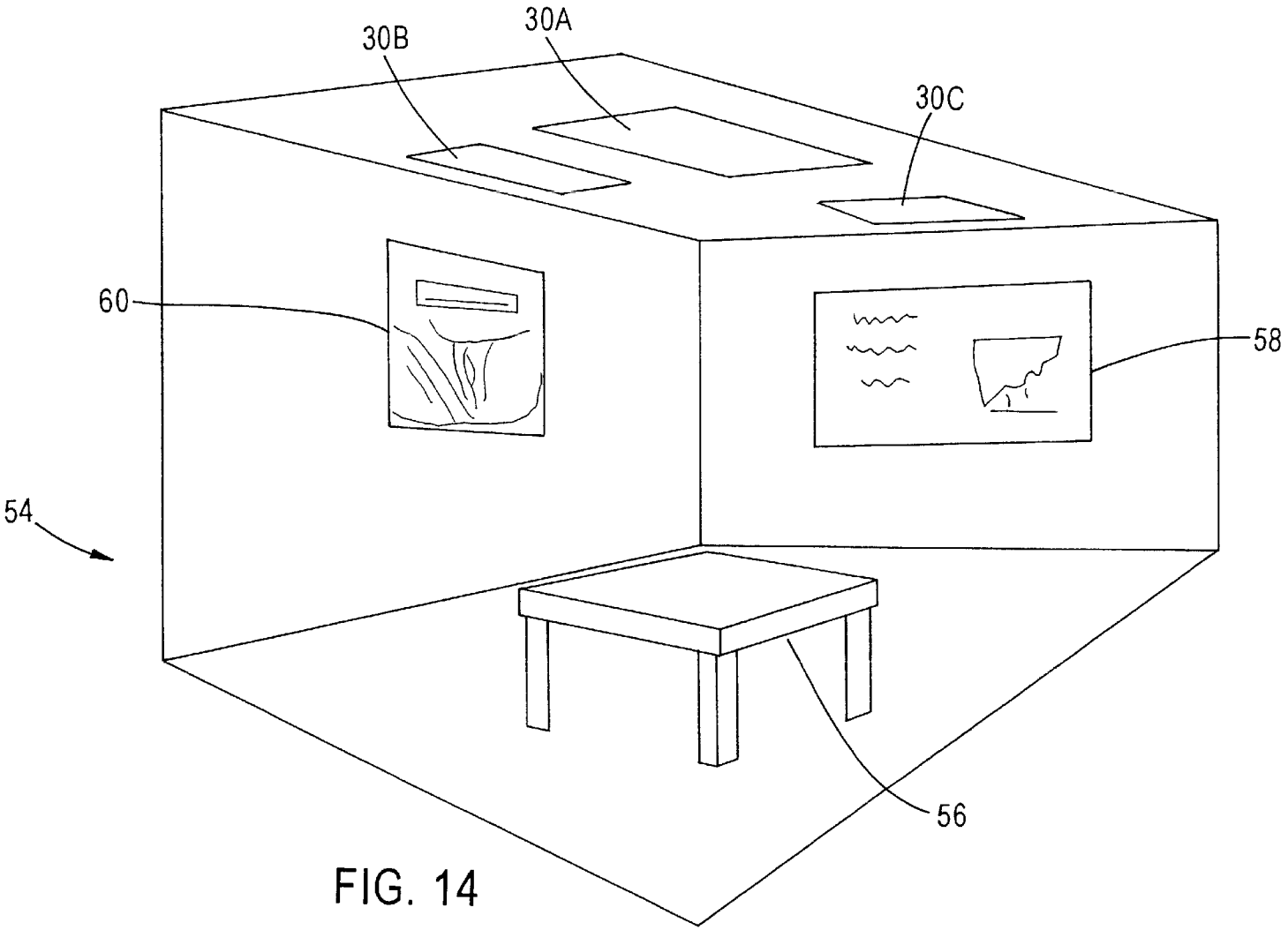
FIG. 14 is a perspective view of a conference room using the present invention.

The practicality of the VFILF 30 is easy to demonstrate, as depicted in FIG. 14. In the typical conference room 54, there is a need for variable intensity general illumination for normal meetings, note taking, and conversations. This ambient lighting should have a beam angle of 150 degrees so that there is light everywhere and the minimum to maximum ratios of illumination in the room is a very low level. This ambient lighting can be accomplished by using a VFILF 30A adjusted similar to the fixture 30 of FIG. 4. The intensity may need to be adjusted because of slide presentations, computer projected images, or video presentations, e.g., presentations at whiteboard 58. If a conference table 56 is in use and people are seated at the table reading, working, or looking at documents then a higher level of illumination is required on the conference table than elsewhere in the room. Here, fixture 30A adjusted similar to the fixture 30 of FIG. 5 is used to illuminate only the conference table with high quality indirect lighting.

The use of whiteboards 58, chalk boards, or wall displays 60 may require a higher degree of illumination on a particular wall. Asymmetrical focusable indirect lighting fixtures 30B and 30C, e.g., the fixtures depicted in FIGS. 8 and 10, can be used to accomplish this task. Alternatively, a single fixture having separately adjustable left and right-hand reflectors 32, e.g., the fixture 30 of FIG. 11, may be used in place of fixtures 30B and 30C.

It is advantageous that a given fixture can be offered in different distribution angles or beam spreads. If a customer knows the mounting height of the fixture and the size of the room or the size of the task area to be lit, and the desired intensity of the illumination of the room or area, the fixture can be set to use the least amount of fixtures to accomplish these objectives. Some direct illumination fixtures are able to do this now, but not with recessed or surface mounted down lighting fixtures.

The outdoor applications of the VFILF can be for parking lot lighting outdoors where even illumination and minimum glare are required or any other outdoor area lighting application. The indoor applications are unlimited but the primary use is for large open office areas where computer monitors are being used is an urgently needed application. Screen glare from direct lighting fixtures is a recognized cause of Computer Vision Syndrome (CVS) and the VFILF will eliminate the glare.

Reducing the connect load for lighting measured in watts per square foot, while providing even illumination without glare is one of the benefits of VFILF. The presence of vertical foot-candles from indirect lighting is extremely important to good illumination since what we see most is vertical surfaces. We rarely look directly down on a horizontal surface to read or study something.

Current lighting practices only measure horizontal foot-candles as a measure of the illumination on a work surface. If the light is coming from a direct light fixture it is coming straight down and little is being sent sideways to provide vertical illumination measured by vertical foot-candles. Television lighting directors were among the first to recognize the importance of vertical foot-candles and to measure them. Football fields, basketball floors, and hockey arenas also had to have the proper horizontal lighting measured in vertical foot-candles so events could be televised.

Vertical foot-candles measure the light that is being directed in a horizontal direction. By having horizontal light from two directions converge on an object it is easier to see the depth of field or spherical shape of an object.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

For example, even though a pair of light sources is described in combination with a second variable focus reflector having two concave surfaces, it is to be understood that multiple light sources may be arranged to provide luminance to each of the concave surfaces. In other words, there does not have to be a one to one correspondence of light sources to concave or curved surfaces on the second reflector.

Further, two or more curved reflective surface panels may be used in place of the single curved reflective surface described in relation to the variable focus reflector 32. Individual concave or curved panels would be joined at center point or center line 33 as necessary to reflect light from light source 40 toward an area to be illuminated.

Further still, it is to be understood that upper reflector 32 may be a different curve or shape depending on the intended use. For example, the upper reflector 32 may have an annular, elliptical, or parabolic cross section.

What I claim is:

1. A variable focus indirect lighting fixture comprising:

a pair of first reflectors wherein each reflector is arranged to substantially surround a light source, wherein each of said first reflectors has an opening arranged to direct lumination from the light source; and a second variable focus reflector positioned in front of each opening of said first reflectors and arranged to receive and reflect the rumination from each light source passing through each opening of said first reflectors, wherein said second reflector has a pair of inner, curved surfaces arranged such that each inner surface faces a respective opening of said first reflectors to receive and reflect the lumination from the respective light source passing through the opening of each of said first reflectors, wherein said inner surfaces are aligned along a center line of said second reflector between said pair of first reflectors, and wherein the center line is adjustable to modify the curvature of the inner surfaces of said second reflector.

2. The fixture as claimed in claim 1, wherein said adjustable center point is manually adjustable.

3. The fixture as claimed in claim 1, wherein said adjustable center point is automatically adjustable.

4. The fixture as claimed in claim 3, wherein said adjustable center point is configured to receive commands from a control remotely located from said lighting fixture and automatically raise or lower the center point of said lighting fixture.

5. The fixture as claimed in claim 1, wherein the light source comprises at least one of a compact fluorescent bulb, a self ballasted fluorescent bulb, an incandescent bulb, an arc tube, a metal halide bulb, a mercury bulb, a low pressure sodium bulb, a high pressure sodium bulb, a light emitting diode, and a variable output single constant source light source.

6. The fixture as claimed in claim 1, wherein said second variable focus reflector has at least one reflective surface.

7. The fixture as claimed in claim 1, wherein said second variable focus reflector has at least one concave surface.

8. The fixture as claimed in claim 1, wherein said inner, reflective, curved surface of said second variable focus reflector is at least one of a parabola, ellipse, and an annular surface.

9. A variable focus indirect lighting fixture comprising:

at least two first reflectors wherein each reflector is arranged to substantially surround a light source, wherein each of said first reflectors has an opening arranged to direct lumination from the light source; and a second variable focus reflector positioned in front of each opening of said first reflectors and arranged to receive and reflect the lumination from each light source passing through each opening of said first reflectors, wherein said second reflector has inner, curved surfaces arranged such that each inner surface faces a respective opening of said first reflectors and arranged to receive and reflect the lumination from the respective light source passing through the opening of each of said first reflectors, wherein said inner surfaces are arranged about a center point of said second reflector between said at least two first reflectors, and wherein the center point is adjustable to modify the curvature of the inner surfaces of said second reflector.

10. A variable focus indirect lighting fixture comprising:

a plurality of first reflectors wherein each reflector is arranged to substantially surround a light source, wherein each of said plurality of first reflectors has an opening arranged to direct lumination from the light source; and a second variable focus reflector positioned in front of each opening of said plurality of first reflectors and arranged to receive and reflect the lumination from each light source passing through each opening of said plurality of first reflectors, wherein said second reflector has a plurality of inner, curved surfaces arranged such that each inner surface faces a respective opening of said plurality of first reflectors to receive and reflect the lumination from the respective light source passing through the opening of each of said plurality of first reflectors, wherein said inner surfaces are arranged about a center point of said second reflector, and wherein the center point is adjustable to modify the curvature of the inner surfaces of said second reflector.

11. A variable focus indirect lighting fixture comprising:

at least two first reflectors wherein each reflector is arranged to substantially surround a light source, wherein each of said plurality of first reflectors has an opening arranged to direct lumination from the light source; and a second variable focus reflector positioned in front of each opening of said first reflectors and arranged to receive and reflect the lumination from each light source passing through each opening of said first reflectors, wherein said second reflector has inner, curved surfaces arranged such that each inner surface faces a respective opening of said first reflectors and arranged to receive and reflect the lumination from the respective light source passing through the opening of each of said first reflectors, wherein said inner surfaces are arranged about an adjustment point of said second reflector between said at least two first reflectors and wherein the adjustment point is adjustable to modify the curvature of the inner surfaces of said second reflector.

12. The fixture as claimed in claim 11, wherein the adjustment point is closer to one of said first reflectors.

13. A variable focus indirect lighting fixture comprising:

at least two first reflectors wherein each reflector is arranged to substantially surround a light source, wherein each of said plurality of first reflectors has an opening arranged to direct lumination from the light source; and a second variable focus reflector positioned in front of each opening of said first reflectors and arranged to receive and reflect the lumination from each light source passing through each opening of said first reflectors, wherein said second reflector has inner, curved surfaces arranged such that each inner surface faces a respective opening of said first reflectors and arranged to receive and reflect the lumination from the respective light source passing through the opening of each of said first reflectors, wherein said inner surfaces are arranged about at least two adjustment points of said second reflector between said at least two first reflectors and wherein said adjustment points are adjustable to modify the curvature of the inner surfaces of said second reflector.

* * * * *